United States Patent [19]

Fontaine et al.

[11] Patent Number: 4,462,823

[45] Date of Patent: Jul. 31, 1984

[54] TREATMENT AGENTS FOR MOLTEN STEEL

[75] Inventors: Paul I. Fontaine, Solihull; Evan T. R. Jones, Sutton Coldfield; John K. Batham, Brierley Hill, all of England

[73] Assignee: Foseco International Limited, Birmingham, England

[21] Appl. No.: 554,700

[22] Filed: Nov. 23, 1983

[30] Foreign Application Priority Data

Dec. 11, 1982 [GB] United Kingdom ..... 8235377

[51] Int. Cl.[3] ..... C21C 7/02

[52] U.S. Cl. ..... 75/58; 75/53; 75/93 G; 75/257

[58] Field of Search ..... 75/58, 53, 936, 257

[56] References Cited

U.S. PATENT DOCUMENTS 4,126,453 11/1979 Heck ..... 75/53

4,137,072 1/1979 Kawakami ..... 75/53

OTHER PUBLICATIONS

D. J. Chakrabarti et al., "An Efficient Process for Desulphurization of Ferrous Melts".

*Primary Examiner*—Peter D. Rosenberg

*Attorney, Agent, or Firm*—Cushman, Darby & Cushman

[57] ABSTRACT

Treatment agents for steel suitable for desulphurizing molten steel comprise granules containing both magnesium oxide and/or carbonate and aluminium, the proportion of aluminium in the surface of the granules being substantially less than the overall proportion of aluminium in the granules. The granules are suitable for application into the molten steel via injection techniques.

14 Claims, No Drawings

TREATMENT AGENTS FOR MOLTEN STEEL

The invention concerns treatment agents for molten steel, and a method of treating molten steel.

Lime is a useful, inexpensive, desulphurisation agent for steel although it has the disadvantage that large amounts of slag result. In contrast, magnesium oxide is not an efficient desulphurisation agent for steel. However, metallic magnesium is an efficient desulphurisation agent for steel and is used for this purpose despite its expense and other drawbacks e.g. application difficulties arising from the low boiling point of magnesium and its very high vapour pressure in steel melts at typical refining temperatures.

According to the present invention a treatment agent for molten steel is in particulate form and comprises granules containing both magnesium oxide and/or carbonate and aluminium, the proportion of the aluminium in the surface of the granules being substantially less than the overall proportion of aluminium in the granules.

The aluminium constituent of the granules may be regarded as encapsulated by the other constituents of the granules and preferably such encapsulation should account for at least 95% by weight of the aluminium present in the granules. Even more preferably, the proportion of aluminium at the surface of the granules is zero.

Treatment agents of the invention do not require the use of metallic magnesium and enable disadvantages, including the expense, of metallic magnesium-based treatment agents to be avoided whilst permitting advantages of such agents e.g. high affinity for sulphur to be retained. Moreover, in use the granular treatment agents of the invention give less fume than known particulate treatment agents such as limebased powders.

Treatment agents of the invention are especially useful for desulphurisation of steel. The treatment agent may have other useful effects in addition to desulphurization. For example, the treatment agent may be used to deoxidise steel as well as to desulphurise it and also to modify inclusions in a manner to improve the quality of the steel.

The treatment agent contains magnesium oxide and/or carbonate but lime and/or calcium carbonate and sodium carbonate may also be present; magnesium carbonate and calcium carbonate may be provided together by use of dolomite, and magnesium oxide and lime may be provided together by use of calcined dolomite. The weight ratio of magnesium oxide (as such or combined as magnesium carbonate) to aluminium in the granules is preferably from 2.3:1 to 3.3:1 as such ratios favour efficient desulphurisation without leading to an undesirable aluminium content in the treated steel. Usually it is preferred that the granules should contain 40 to 75% by weight of magnesium oxide and 15 to 35% by weight of aluminium. The aluminium in the treatment agent may be partly replaced by calcium, calcium alloys, alkali and rare earth metals and alloys or silicon.

The granules preferably contain a fluxing agent e.g. calcium fluoride or magnesium fluoride. Preferably 2 to 20% by weight of a fluxing agent is present. The inclusion of a fluxing agent aids efficient reaction of the treatment agent with the molten steel being treated and separation of the reaction products from the treated steel.

In accordance with the invention the treatment agent is preferably made by mixing the desired ingredients, in particulate form, together with a proportion of binder, in a high energy mixer. The mixing can be effected at ordinary ambient temperatures. The binding agent may be one or more of water, bitumen, starch, phenol-formaldehyde resin, urea-formaldehyde resin, alkali or alkaline earth metal silicates, sodium chloride or colloidal oxide hydrosols.

If the magnesium oxide is provided by use of soft-burnt magnesite water alone will suffice as binder. However, in the case of hard-burnt magnesite the binder used is preferably a mixture of water, sodium chloride and starch.

Moreover, the mixing process can readily be so controlled to give granules in a particular size range. Preferably the granules are in the size range of 0.1 mm to 3.0 mm in diameter, more preferably 0.2 mm to 1.0 mm. It is preferred that the granules as supplied for use should have a low water content e.g. not greater than 1% by weight and, if the water content of the granules as initially formed is higher than this, then the granules as formed may be dried to a desired low water content e.g. at temperatures up to 450° C. If the ingredients include an ingredient that is highly reactive with water, it may be appropriate to use a binder containing little or no water.

The method of making the treatment agent is selected on the basis that the resultant granules contain a substantial proportion of the aluminium encapsulated by the other ingredient or ingredients and the particle sizes of the ingredients are preferably so chosen as to promote this result.

It has been found that granules in which the aluminium is encapsulated to an extent of at least 95% by weight of the total aluminium present in the granules are particularly effective in the treatment of molten steel. In particular a very efficient desulphurising agent for molten steel is produced. The reason for this good result is believed to relate to the fact that there is little or no diffusion of aluminium into the molten steel. This is particularly surprising given the relatively small particle size of the granules compared with other forms of desulphurising agents e.g. briquettes. However, in practice it has been found that the granules of the present invention are very efficient agents for removing sulphur from steels to very low levels of final sulphur.

If the method selected is a granulation process in which water is used as a granulation aid and/or binder it has been found preferable to employ between about 14% to about 19% by weight of water when the magnesium oxide is provided by soft-burnt magnesite and about 10% to about 14% by weight of water for hard-burnt magnesite.

According to a further aspect of the invention a molten steel is treated with the treatment agent by injection of the agent in a carrier gas, preferably nitrogen or argon, into the steel. Injection of the treatment agent aids efficient utilisation of the agent, an effect difficult to achieve in the case of treatment agents in the form of briquettes or the like, which cannot be applied by injection.

The treatment of the steel is preferably carried out whilst the steel is in a ladle. The temperature of the steel treated is preferably in the range of 1500° to 1700° C.

The following is an example of the production of a treatment agent of the invention.

EXAMPLE 1

67.5 parts by weight of magnesium oxide, 22.5 parts by weight of aluminium and 10 parts by weight of calcium fluoride, all in particulate form, together with 16 parts by weight of water were mixed in a high energy mixer to yield granules having particle sizes predominantly in the range of 0.2 mm to 1.5 mm. The water content after drying at 425° C. was <0.5%.

Further examples of treatment agents made according to the present invention are as follows:

EXAMPLE 2

| Ingredient | Parts by weight |
|---|---|
| magnesium oxide | 70.0 |
| aluminium | 30.0 |

The preparation as in Example 1 was repeated with the exception that 15 parts by weight of water were added to the particulate matter. The water content after drying at 425° C. was <0.5%.

EXAMPLE 3

| Ingredient | Parts by weight |
|---|---|
| magnesium oxide | 54.0 |
| aluminium | 18.0 |
| calcium fluoride | 10.0 |
| calcium carbonate | 18.0 |

This composition was prepared in the manner prescribed for Examples 1 and 2 above.

EXAMPLE 4

| Ingredient | Parts by weight |
|---|---|
| magnesium oxide | 50.0 |
| aluminium | 17.0 |
| calcium carbonate | 19.5 |
| calcium fluoride | 10.0 |
| sodium chloride | 2.5 |
| starch | 1.0 |

This composition was prepared as stated in the earlier examples with the exception that 11.6 parts by weight of water were used and the final water content after drying at 425° C. was <0.2%.

EXAMPLE 5

| Ingredient | Parts by weight |
|---|---|
| magnesium oxide | 56.0 |
| aluminium | 19.0 |
| calcium carbonate | 21.5 |
| sodium chloride | 2.5 |
| starch | 1.0 |

In this case 12 parts by weight of water were used and the final water content was <0.2%.

Examples of further compositions for processing instead of the compositions specified above include:

EXAMPLE 6

| Ingredient | Parts by weight |
|---|---|
| magnesium oxide | 56.0 |
| aluminium | 20.0 |
| calcium fluoride | 8.0 |
| dolomite limestone | 16.0 |

EXAMPLE 7

| Ingredient | Parts by weight |
|---|---|
| magnesium oxide | 61.0 |
| aluminium | 20.0 |
| calcium fluoride | 9.0 |
| sodium carbonate | 10.0 |

Small scale trials were conducted involving injecting treatment agents of the invention, and other treatment agents for comparative purposes into steel melts. The details and results are shown in Tables 1 and 2 hereafter. The compositions specified as containing magnesium oxide (MgO) were all treatment agents of the invention. It is to be appreciated that the trials reported in Tables 1 and 2 involved treatment of relatively small quantities of molten steel and in particular injection to relatively shallow depths. The results for treatment of larger quantities of molten steel and injection to deeper depths are reported in Table 3. Calcium silicide and a lime-calcium fluoride powder mixture were chosen as the comparative material as these are commonly used desulphurisation agents for steel.

TABLE 1

INJECTION TRIAL RESULTS

Steel (0.20–0.34% Carbon, 0.2–0.4% Si, 0.9–1.1% Mn)

| | | | | | | | | | | |
|---|---|---|---|---|---|---|---|---|---|---|
| Melt Size (kg) | 350 | 160 | 160 | 160 | 345 | 160 | 160 | 160 | 160 | 160 |
| Injectant Composition | CaSi | CaSi | 85% CaO 15% $CaF_2$ Mixed Powders | 70% MgO 30% Al | 67.5% MgO 22.5% Al 10.0% $CaF_2$ | | | | | |
| Amount Injected (kg) | 1.400 | 0.970 | 1.450 | 1.000 | 1.060 | 0.180 | 1.040 | 1.260 | 0.740 | 0.192 |
| Time of Injection (secs) | 180 | 121 | 120 | 90 | 180 | 30 | 136 | 166 | 113 | 30 |
| Injection Addition (kg/t) | 4.00 | 6.06 | 9.08 | 6.25 | 3.07 | 1.13 | 6.48 | 7.87 | 4.63 | 1.20 |
| Sulphur Content (wgt %) | | | | | | | | | | |
| Start | 0.061 | 0.048 | 0.064 | 0.091 | 0.067 | 0.057 | 0.0570 | 0.0405 | 0.0430 | 0.057 |
| Final | 0.033 | 0.021 | 0.027 | 0.049 | 0.037 | 0.042 | 0.0085 | 0.0056 | 0.0175 | 0.040 |
| Sulphur Removal | 45.9 | 56.3 | 57.8 | 46.2 | 44.8 | 26.3 | 85.1 | 86.2 | 59.3 | 29.8 |

TABLE 1-continued

INJECTION TRIAL RESULTS

Steel (0.20–0.34% Carbon, 0.2–0.4% Si, 0.9–1.1% Mn)

Efficiency (%)

All melts nominally at 1600° C.–1620° C. in neutral or basic lined induction furnace or ladles with lime-fluorspar cover slag.

TABLE 2

INJECTION TRIAL RESULTS

Steel (0.12% Carbon, 0.2% Si)

| | | | | | | | | | | | | |
|---|---|---|---|---|---|---|---|---|---|---|---|---|
| Melt Size (kg) | 160 | 160 | 350 | 350 | 160 | 160 | 500 | | | | | |
| Injectant Composition | CaSi | CaSi | MgO 54%<br>Al 18%<br>$CaF_2$ 10%<br>$CaCO_3$ 18% | | MgO 50%<br>Al 17%<br>$CaF_2$ 10% | $CaCO_3$ 19.5%<br>Starch 1.0%<br>NaCl 2.5% | MgO 56%<br>Al 19%<br>$CaCO_3$ 21.5% | Starch 1.0%<br>NaCl 2.5% | | | | |
| Amount Injected | 0.460 | 0.540 | 1.505 | 0.665 | 0.650 | 0.434 | 1.520 | | | | | |
| Time of Injection (secs) | 75 | 87 | 113 | 48 | 60 | 60 | 90 | | | | | |
| Injection Addition (kg/t) | 2.88 | 3.38 | 4.30 | 1.90 | 4.07 | 2.71 | 3.04 | | | | | |
| Sulphur Content (wgt %) | | | | | | | | | | | | |
| Start | 0.0160 | 0.0250 | 0.032 | 0.014 | 0.0180 | 0.028 | 0.0230 | | | | | |
| Final | 0.0028 | 0.0046 | 0.001 | 0.004 | 0.0018 | 0.002 | 0.0052 | | | | | |
| Sulphur Removal Efficiency (%) | 82.5 | 81.6 | 96.9 | 71.4 | 90.0 | 92.8 | 77.4 | | | | | |

All melts nominally at 1600° C.–1620° C. in neutral or basic lined induction furnace or ladles with lime-fluorspar cover slag.

TABLE 3

INJECTION TRIAL RESULTS

Steel (0.12% C, 0.2% Si)

| | | | | |
|---|---|---|---|---|
| Melt Size (tonne) | 2.64 | 125 | 2.78 | 125 |
| Injectant Composition | CaSi | CaSi | MgO 54%<br>Al 18%<br>$CaF_2$ 10%<br>$CaCO_3$ 18% | |
| Amount Injected (kg) | 10.0 | 250 | 10.0 | 270 |
| Time of Injection (secs) | 406 | 360 | 465 | 360 |
| Injection Addition (kg/t) | 3.78 | 2.00 | 3.60 | 2.16 |
| Sulphur Content (wgt %) | | | | |
| Start | 0.0190 | 0.0163 | 0.017 | 0.020 |
| Final | 0.0043 | 0.0080 | 0.004 | 0.007 |
| Sulphur Removal Efficiency (%) | 77.3 | 50.9 | 76.5 | 65.0 |

All melts nominally at 1600° C.–1620° C. in neutral or basic lined induction furnace or ladles with lime-fluorspar cover slag.

We claim:

1. A particulate treatment agent for molten steel which comprises granules containing aluminium and at least one magnesium compound selected from the group consisting of magnesium oxide and magnesium carbonate, the proportion of the aluminium in the surface of the granules being substantially less than the overall proportion of aluminium present in the granules.

2. A method of forming a treatment agent for molten steel comprising the steps of:

providing particulate constituent or constituents containing an aluminum and at least one magnesium compound selected from the group consisting of magnesium oxide and magnesium carbonate;

providing a binding agent; and mixing the particulate constituent or constituents with the binding agent in a high energy mixer to produce granules having a proportion of aluminum in the surface of the granules substantially less than the overall proportion of aluminum present in the granules.

3. A method of desulfurizing and/or dephosphorizing molten steel comprising the step of:

injecting into the molten steel a treatment agent which comprises granules containing aluminum and at least one magnesium compound selected from the group consisting of magnesium oxide and magnesium carbonate, the proportion of aluminum in the surface of the granules being substantially less than the overall proportion of aluminum present in the granules.

4. A treatment agent according to claim 1 wherein at least 95% by weight of the aluminium is enclosed by the other ingredients.

5. A treatment agent according to claim 1 wherein the granules also contain at least one alkali metal or alkaline earth metal compound selected from the group consisting of lime (CaO), calcium carbonate and sodium carbonate.

6. A treatment agent according to claim 1 wherein the granules contain dolomite.

7. A treatment agent according to claim 1 wherein the granules contain calcined dolomite.

8. A treatment agent according to claim 1 wherein the weight ratio of the magnesium compound to aluminium is in the range from 2.3:1 to 3.3:1.

9. A treatment agent according to claim 1 which comprises 40 to 75% by weight magnesium oxide and 15 to 35% by weight of aluminium.

10. A treatment agent according to claim 1 which comprises a fluxing agent.

11. A treatment agent according to claim 9 wherein the fluxing agent is present in an amount of 2 to 20% by weight.

12. A treatment agent according to any preceding claim wherein the particle size range of the granules is 0.1 mm to 3.0 mm.

13. A treatment agent according to claim 11 wherein the particle size range is 0.2 mm to 1.0 mm.

14. A method according to claim 2 wherein the least 95% by weight of the aluminium content is encapsulated by the other constituent or constituents.

* * * * *